United States Patent [19]

Minami

[11] 4,069,780

[45] Jan. 24, 1978

[54] SEWING MACHINE WITH MEANS FOR STITCHING SLIDE FASTENER STRINGERS ONTO A RELATIVELY THICK ARTICLE

[75] Inventor: Tadashi Minami, Kurobe, Japan

[73] Assignee: Yoshida Kogyo Kabushiki Kaisha, Japan

[21] Appl. No.: 682,260

[22] Filed: May 3, 1976

[30] Foreign Application Priority Data

May 9, 1975 Japan ..... 50-55758

[51] Int. Cl.[2] ..... D05B 29/06; D05B 35/06

[52] U.S. Cl. ..... 112/150; 112/104; 112/163; 112/235

[58] Field of Search ..... 112/104, 113, 120, 150, 112/163, 235, 136, 147, 240

[56] References Cited

U.S. PATENT DOCUMENTS

| | | | |
|---|---|---|---|
| 968,852 | 8/1910 | Jacobson | 112/147 |
| 1,242,405 | 10/1917 | Wiggins | 112/147 |
| 1,376,623 | 5/1921 | Hughes, Jr. | 112/147 |
| 2,133,225 | 10/1938 | Goodwin | 112/147 |
| 2,159,538 | 5/1939 | Zablocki | 112/136 |
| 2,329,991 | 9/1943 | Kellum | 112/136 |
| 2,334,150 | 11/1943 | Sailer | 112/136 |
| 3,318,273 | 5/1967 | Eddy | 112/235 |
| 3,334,605 | 8/1967 | Boser | 112/235 |

FOREIGN PATENT DOCUMENTS

| | | | |
|---|---|---|---|
| 725,353 | 1/1966 | Canada | 112/265 |
| 389,535 | 7/1965 | Switzerland | 112/265 |

*Primary Examiner*—Werner H. Schroeder
*Assistant Examiner*—Moshe I. Cohen
*Attorney, Agent, or Firm*—Bucknam and Archer

[57] ABSTRACT

A twin-needle sewing machine for stitching lap seams which have been produced by basting a pair of fastener stringers to the edges of an article bounding an opening therein and then by folding the article edges along the basting lines. The sewing machine has a presser foot comprising a pair of parallel spaced main portions, and a pair of wings projecting laterally outwardly from the respective main portions. A guide fixedly mounted on the throat plate of the sewing machine has its sloping rear surface disposed opposite to the front end of the presser foot. The folded article edges together with the stringers basted thereto follow a curved path created by the guide as they are drawn under the presser foot for final stitching of the lap seams, in order that the article edges may not unfold.

5 Claims, 7 Drawing Figures

SEWING MACHINE WITH MEANS FOR STITCHING SLIDE FASTENER STRINGERS ONTO A RELATIVELY THICK ARTICLE

BACKGROUND OF THE INVENTION

1. Field of the Invention

This invention relates to sewing machines, and more specifically to improved means to be incorporated in a sewing machine to adapt the latter for stitching slide fastener stringers to the edges of padded ski pants and other relatively thick articles bounding openings therein.

2. Description of the Prior Art

Great difficulties have been encountered in machine sewing fastener stringers onto, for example, the folded slit-bounding edges at the bottoms of ski pants padded with polyurethane foam or like spongy material. The resiliency of the padding is such that the edges of such articles cannot possibly be held neatly folded and placed in position over the stringer tapes as they are fed under the presser foot of a sewing machine. It has therefore been practically impossible to stitch fastener stringers directly onto the folded edges of such padded articles.

In an attempt to overcome this problem, it has been suggested to baste or stitch, before final stitching, a pair of separated fastener stringers onto the right sides of the article edges, with the elements carrying edges of the stringer tapes disposed away from each other. Then, with the rows of elements interengaged by a slider movable therealong, only the article edges are folded back along the basting lines, wrong sides together, and the fastener stringers are finally stitched so as to form the so-called lap seams.

This scheme, however, provides only a partial solution to the above noted problem when employed in conjunction with a conventional sewing machine. The edges of padded ski pants or the like, even if basted to the fastener stringers, are easy to unfold immediately before being drawn under the presser foot of the sewing machine by its feed mechanism, so that it is highly difficult to form the desired lap seams in the case of such thick and resilient articles.

SUMMARY OF THE INVENTION

It is an object of this invention to provide improved means to be incorporated in a sewing machine whereby fastener stringers can be efficiently stitched onto the folded edges of relatively thick articles bounding openings therein.

Another object of the invention is to provide means of the character specified which is well adaptable for use in a twin-needle sewing machine for simultaneously stitching a pair of fastener stringers onto a desired article.

This invention is specifically directed to the novel construction of a presser foot supported above the throat plate of a sewing machine, and to guide means on the throat plate cooperating with the presser foot to provide a curved path for a folded article edge together with a fastener stringer basted thereto as they are drawn under the presser foot for final stitching of the lap seam. The curvature imparted to the folded article edge serves to hold same neatly folded.

The above and various other objects, features, and advantages of this invention will become more clearly apparent in the course of the following description of a preferred embodiment, which is to be read in connection with the accompanying drawings.

DESCRIPTION OF THE PREFERRED EMBODIMENT

Figure 1:
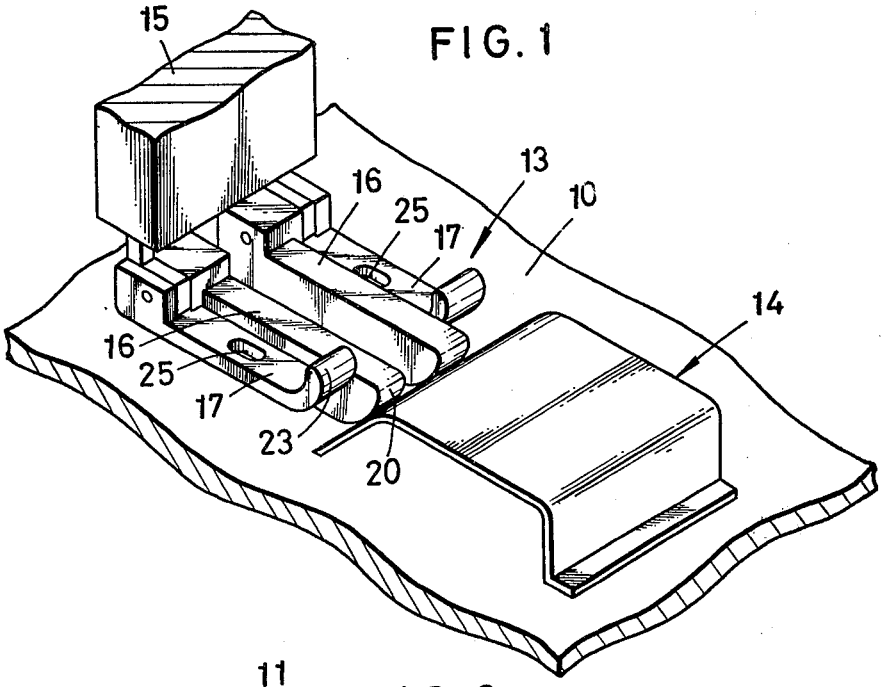
FIG. 1 is a perspective view of a preferred form of the means according to this invention as incorporated in a twin-needle sewing machine.
Figure 2:
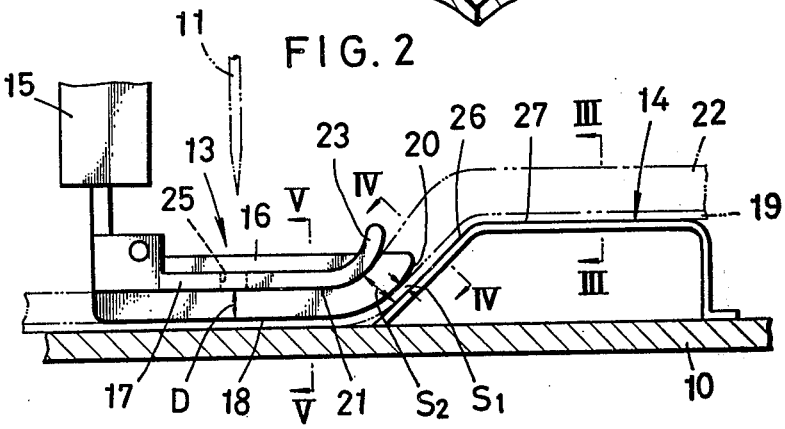
FIG. 2 is a side elevational view of the arrangement of FIG. 1, the view being also illustrative of the way a pair of fastener stringers are stitched onto the folded edges of an article by the sewing machine.

In the accompanying drawings the invention is shown adapted for a twin-needle sewing machine whereby a pair of fastener stringers can be simultaneously stitched onto the folded edges of a desired article bounding an opening therein. With particular reference to FIGS. 1 and 2, the sewing machine has a throat plate 10 through which a pair of needles 11 are movable up and down and which has a feed dog mechanism 12, FIG. 5, for feeding the material being stitched in a predetermined direction, which is leftward as seen in FIG. 2. The invention is specifically directed to the construction of a presser foot 13 supported over the throat plate 10 and to a guide 14 arranged forwardly of the presser foot.

The pressure foot 13 is constituted of a pain of horizontally spaced sections conveniently supported at the bottom end of a presser bar 15 which is suspended from the arm, not shown, of the sewing machine. These two presser foot sections can be identical in construction, so that the following description of one of the sections applies to the other as well.

Each section of the presser foot 13 comprises a main portion 16 of substantially rectangular shape extending in the direction of travel of the material being stitched over the throat plate 10, and a wing 17 projecting laterally or outwardly from the main portion 16. The main portion 16 has a horizontal bottom surface 18 which, when the presser foot is in the illustrated working position, is spaced from the throat plate 10 to such as extent as to permit one of a pair of slide fastener stringer tapes 19, FIGS. 3 through 5, to pass therebetween. The main portion 16 also has a front surface 20 sloping upwardly and forwardly from the bottom surface 18. Preferably, this front surface 20 should be suitably rounded, as best shown in FIG. 2, so that the stringer tapes 19 may be guided smoothly under the presser foot 13.

Figure 5:
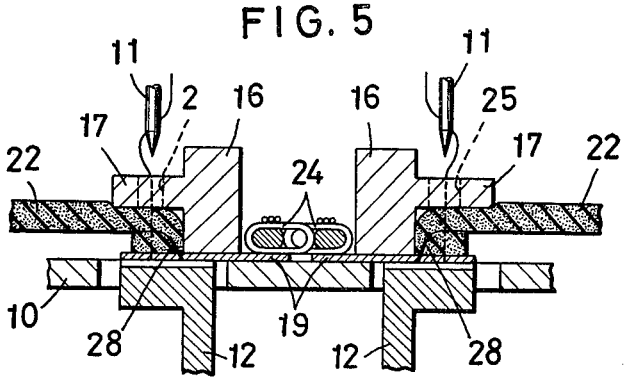
FIG. 5 is a cross-sectional view taken along the line V—V of FIG. 2.

The wing 17 has a horizontal bottom surface 21 which is higher than the bottom surface 18 of the main portion 16 by a distance D approximately equal to, or slightly less than, twice the thickness of each edge of the article 22 such as padded ski pants to which the fastener stringers are to be stitched, as will be understood upon consideration of FIG. 5. The wing 17 also has a front surface 23 sloping upwardly and forwardly from its bottom surface 21. This front surface of the wing 17, which should also be preferably rounded as best shown in FIG. 2, is disposed rearwardly of the front surface 20 of the main portion 16 substantially in parallel relationship thereto.

Figure 4:
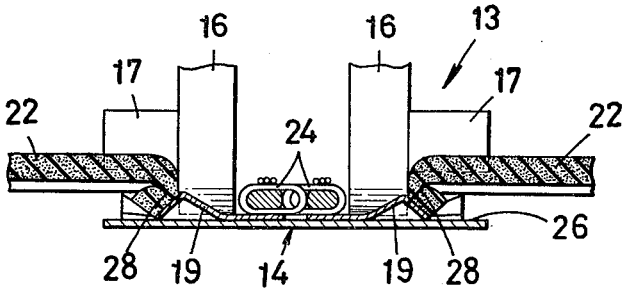
FIG. 4 is a cross-sectional view taken along the line IV—IV of FIG. 2.

As will be seen from FIGS. 4 and 5, the pair of main portions 16 of the presser foot 13 are spaced from each other a sufficient distance to permit a pair of interengaged rows of fastener elements 24 on the stringer tapes 19 to pass therebetween. The pair of wings 17 have formed therein needle holes 25 through which the needles 11 pass for stitching the stringer tapes 19 onto the folded edges of the article 22, respectively.

The guide 14 is in the form of a strip of relatively rigid material such as, for example, metal, which is fixedly mounted on the throat plate 10. The guide 14 is bent into the illustrated shape to provide a sloping rear surface 26 and a horizontal top surface 27. The rear surface 26 of the guide 14 is arranged in opposed relationship to the front surfaces 20 and 23 of the main portions 16 and wings 17 of the presser foot 13.

As indicated in FIG. 2, the spacing S1 between the front surface 20 of each main portion 16 of the presser foot 13 and the rear surface 26 of the guide 14 is approximately equal to the thickness of each stringer tape 19. The spacing S2 between the front surface 23 of each wing 17 of the presser foot and the rear surface 26 of the guide is approximately equal to the thickness of each stringer tape 19 plus twice the thickness of each edge of the article 22.

Figure 3:
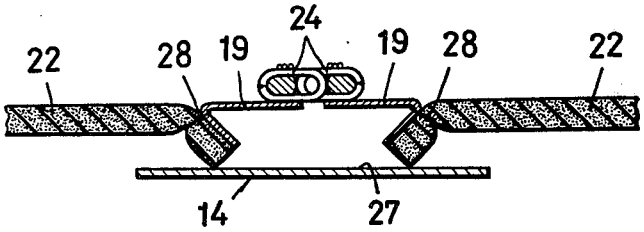
FIG. 3 is a cross-sectional view taken along the line III—III of FIG. 2.

For stitching the pair of fastener stringers onto the article 22 by means of this twin-needle sewing machine, the pair of stringer tapes 19 are precedently be basted or stitched at 28 onto the respective edges of the article as shown in FIG. 3. Then, with the rows of elements 24 on the stringer tapes 19 interengaged by a slider, not shown, the fastener stringers and article edges are placed upon the top surface 27 of the guide 14 and, as shown in FIG. 4, are manipulated into the spacing between the rear surface 26 of the guide and the front surfaces 20 and 23 of the presser foot 13 while the article edges are being manually folded back along the respective basting lines 28 so as to form lap seams.

In the above instance, as will be noted from FIGS. 4 and 5, the folded article edges together with parts of the stringer tapes 19 are manipulated into the respective spacings S2 between the rear surface 26 of the guide 14 and the front surfaces 23 of the wings 17. The interengaged rows of elements 24 are inserted into the spacing between the pair of main portions 16.

Thus, as the sewing machine is set in operation, the fastener stringers and folded article edges are fed under the presser foot 13 in the aforesaid predetermined direction by the feed dog mechanism 12, while the pair of needles 11 move up and down past the wings 17 and the throat plate 10 for simultaneously stitching the stringer tapes 19 onto the respective folded article edges to complete the lap seams.

Figure 6A:
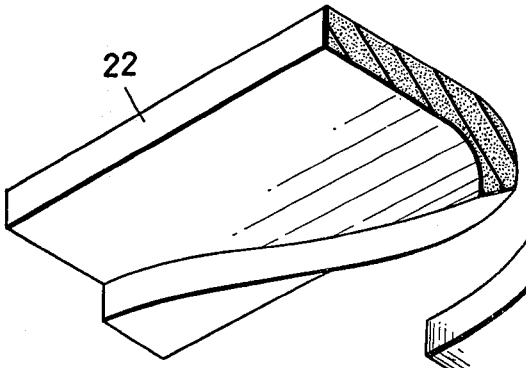
FIG. 6A is a perspective view illustrative of the fact that an edge of a thick and resilient article such as padded ski pants tends to unfold when same is straightened in accordance with the prior art.
Figure 6B:
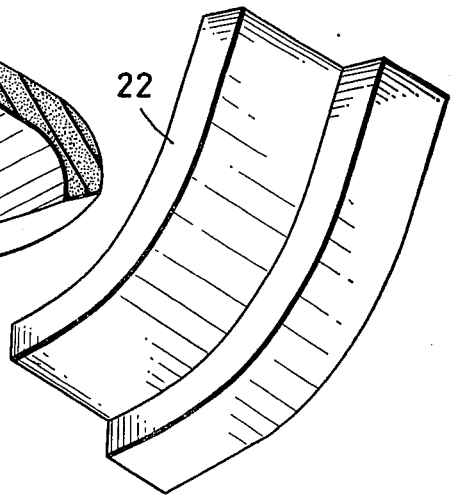
FIG. 6B is a perspective view illustrative of the fact that the article edge remains folded when curved in accordance with the teaching of this invention.

It is particularly noteworthy that in accordance with this invention, each folded edge of the article 22, together with one of the stringer tapes 19 basted thereto, is curved as depicted on an enlarged scale in FIG. 6B as it travels from the sloping rear surface 26 of the guide 14 onto the throat plate 10 under one of the wings 17. As will be apparent, the article edge when thus curved remains folded more firmly than when it is straightened as in FIG. 6A, as has been the case heretofore. The sewing machine incorporating the means of this invention is therefore particularly well adapted for stitching stringers onto the slitted bottoms of padded ski pants or similarly thick articles.

It is to be understood that this invention is not to be limited to the exact details of the embodiment disclosed herein since same is intended to be illustrative of the principles of the invention. The concept and principles of the invention may be adapted for various types of sewing machines and embodied in other forms. The invention, therefore, is to be accorded the full scope of the claims appended hereto.

What is claimed is:

1. In a sewing machine for stitching a stringer tape onto an article, wherein the sewing machine is of the type having a needle movable up and down through a throat plate, the improvement comprising:

a. A presser foot supported above said throat plate, said presser foot comprising:

1. a main portion having a bottom surface spaced sufficiently from said throat plate to permit the stringer tape to pass therebetween, said main portion also having a front surface sloping forwardly from said bottom surface, said main portion having a lateral surface adjoining said bottom surface thereof; and 2. a wing projecting laterally from said main portion, said wing having a bottom surface higher than said bottom surface of said main portion by a distance approximately equal to twice the thickness of the article, said wing also having a front surface sloping forwardly from said bottom surface thereof, said front surface of said wing being disposed rearwardly of said front surface of said main portion and being spaced therefrom a distance approximately equal to twice the thickness of the article, said bottom surface of the wing adjoining said lateral surface of the main portion and cooperating with said main portion lateral surface and the throat plate to accommodate passage under the presser foot of a folded edge portion of an article secured to the stringer tape, with overlapped parts of said folded edge portion and an adjoining portion of the stringer tape being confined between the throat plate and bottom surface of the wing, to accommodate stitching together said overlapped parts and the stringer tape; and b. guide means on said throat plate for providing a sloping guide surface in opposed relationship to said front surfaces of said main portion and said wing of said presser foot, said guide surface being spaced sufficiently from said front surface of said main portion to permit the stringer tape to pass therebetween.

2. The improvement as recited in claim 1, wherein said guide means is a strip of relatively rigid material fixedly mounted on said throat plate.

3. The improvement as recited in claim 2, wherein said strip is formed to include a horizontal top surface over which the stringer tape and the article travel onto said sloping guide surface.

4. The improvement as recited in claim 1, wherein said wing has formed therein a needle hole through which said needle passes for stitching the stringer tape onto the article.

5. In a sewing machine for simultaneously stitching onto an article a pair of fastener stringer tapes carrying interengaged rows of elements thereon, wherein the sewing machine is of the type having a pair of needles movable up and down through a throat plate, the improvement comprising:

a. a presser foot supported above said throat plate, said presser foot comprising:

1. a pair of main portions of identical make horizontally spaced from each other a distance sufficient to permit the interengaged rows of elements to pass therebetween, each main portion having a bottom surface sufficiently spaced from said throat plate to permit one of the stringer tapes to pass therebetween, each said main portion also having a front surface sloping forwardly from said bottom surface, each main portion having a lateral surface adjoining said bottom surface thereof; and 2. a pair of wings of identical make projecting laterally outwardly from said main portions respectively, each wing having a bottom surface higher than said bottom surface of the corresponding main portion by a distance approximately equal to twice the thickness of the article, each said wing also having a front surface sloping forwardly from said bottom surface thereof said front surface of each said wing being disposed rearwardly of said front surface of the corresponding main portion and being spaced therefrom a distance approximately equal to twice the thickness of the article, the bottom surface of each wing adjoining the lateral surface of a corresponding main portion and cooperating therewith and with the throat plate to accommodate passage under the presser foot of respective opposed folded edge portions of an article secured each to a corresponding stringer tape, with overlapped parts of each folded edge portion and an adjoining portion of the corresponding stringer tape being confined between the throat plate and bottom surface of the respective wing, to accommodate stitching together said overlapped parts and the stringer tape; and b. means on said throat plate for providing a sloping guide surface in opposed relationship to said front surfaces of said main portions and said wings of said presser foot, said guide surface being sufficiently spaced from said front surface from said front surface of each said main portion to permit one of the stringer tapes to pass therebetween.

* * * * *